United States Patent [19]

Harada et al.

[11] Patent Number: 4,577,674

[45] **Date of Patent: * Mar. 25, 1986**

[54] GUIDE ROLL

[75] Inventors: Shinichi Harada; Hiroshi Toyoda, both of Kobe; Katsuhiko Honma, Akashi; Shigeru Matsushita, Nishinomiya, all of Japan

[73] Assignee: Kabushiki Kaisha Kobe Seiko Sho, Kobe, Japan

[ * ] Notice: The portion of the term of this patent subsequent to Mar. 25, 2003 has been disclaimed.

[21] Appl. No.: 516,280

[22] Filed: Jul. 22, 1983

[51] Int. Cl.[4] ..... B22D 11/12

[52] U.S. Cl. ..... 164/448; 164/442; 29/124

[58] Field of Search ..... 164/447, 448, 441–443, 164/428, 463, 480; 29/124, 125

[56] References Cited

U.S. PATENT DOCUMENTS 800,845 10/1905 Fletcher ..... 29/124

978,080 12/1910 Vieser ..... 29/124

*Primary Examiner*—Nicholas P. Godici

*Attorney, Agent, or Firm*—Oblon, Fisher, Spivak, McClelland & Maier

[57] ABSTRACT

A guide roll particularly suitable for conveying workpieces of high temperature, which: includes a steel core shaft internally provided with a cooling water passage along the axis thereof; a ceramic sleeve covering the circumference of the core shaft and constituted by a plurality of separable annular ceramic segments loosely fitted on and along the length of the core shaft; and fixing members for holding the respective annular ceramic in axially abutted state on the core shaft.

10 Claims, 9 Drawing Figures

GUIDE ROLL

BACKGROUND OF THE INVENTION

1. Field of the Invention

This invention relates to guide rolls, and, more particularly, to a guide roll construction suitable for conveying hot works, for example, in continuous metal casting operations, ingot-making operations or in an anterior stage of hot rolling in the steel-making or similar industry.

2. Description of the Prior Art

Conventional guide rolls of this sort are generally constituted by a steel roll shaft of unitary construction to secure necessary strength and are internally provided with a cooling water passage for enhancing the heat resistance of the roll shaft. In some cases, for the purpose of increasing the thermal resistance, there have been used guide rolls with a heat resistance metal surfacing or guide rolls of a composite construction having a sleeve or rings of heat resistant material integrally fitted on the circumference of the roll shaft. However, the conventional integral type guide rolls are unsatisfactory with respect to heat resistance, resistance to thermal shock, resistance to abrasive wear and mechanical strength which are essential for the guide rolls to be used for guiding workpieces of high temperature, in the absence of a unitary or composite material which can meet all of these requirements. With guide rolls of integral construction, maximum stress occurs in the center portion of the circumference of each roll shaft due to the bending caused by the reaction force imposed on the high temperature workpiece during its transfer, and it is extremely difficult to cope with it in terms of the high temperature strength of the roll material.

Further, in the continuous casting process, there is an increasing trend toward energy conservation, retaining the heat of the hot cast stock while it is transferred after severing and utilizing its heat effectively in the subsequent hot rolling. In the continuous casting operation, the guide rolls which convey a continuously cast strip from a water-cooled mould to a shearing machine are subjected to a high temperature above 1000° C. so that more severe conditions are imposed on such guide rolls. In order to lessen thermal deterioration in strength, which will shorten the service life of the guide rolls, and to reduce the heat dissipation from the workpiece to the rolls, it has been proposed to use ceramic material which has high heat resistance along with a high heat insulating property, e.g., embedding a ceramic material in axial or circumferential grooves provided on the circumference of a roll shaft or a sleeve of a heat resistant material which is integrally fitted on a water-cooled roll shaft as mentioned hereinbefore, or mounting a plurality of ceramic pieces on the circumference of a heat insulating sleeve by the use of a corresponding number of fixing means. The conventional guide rolls of this sort are invariably complicated in construction and therefore require an increased number of steps in the machining stage of the roll shaft or the heat insulating sleeve to be fitted on the roll shaft, coupled with the problem that the service life of the fixing means is shortened considerably by thermal fatigue as a result of subjection to the heat of the high temperature workpiece. In addition, the roll as a whole has to be replaced in the event of a damage occurring to a certain part of the roll since a long time period is required for repair.

SUMMARY OF THE INVENTION

It is therefore an object of the present invention to provide a guide roll which will overcome the above-mentioned difficulties or problems.

It is a more specific object of the present invention to provide a guide roll with a ceramic sleeve consisting of a number of loosely fitted ceramic segments, which can prevent an imposed maximum stress from being concentrated at the center of the circumference of the roll shaft so as to prolong its service life.

It is another object of the present invention to provide a guide roll with a ceramic sleeve which consists of a number of loosely fitted ceramic segments which are easy to assemble and disassemble.

It is a further object of the present invention to provide a guide roll of the nature as mentioned above, which permits repair of the roll or replacement of damaged ceramic segments in a prompt manner.

According to the present invention, there is provided a guide roll particularly suitable for conveying workpieces of high temperature, and which basically comprises a core steel shaft internally provided with a cooling water passage along the axis thereof; a ceramic sleeve covering the circumference of the core shaft and constituted by a number of separable annular ceramic segments loosely fitted on and along the length of the core shaft; and fixing means for holding each respective annular ceramic in an axially abutted state on the core shaft.

The above and other objects, features and advantages of the present invention will become apparent from the following description and the appended claims, taken in conjunction with the accompanying drawings which show by way of example some illustrative embodiments of the invention.

DETAILED DESCRIPTION OF THE PREFERRED EMBODIMENTS

Figure 1:
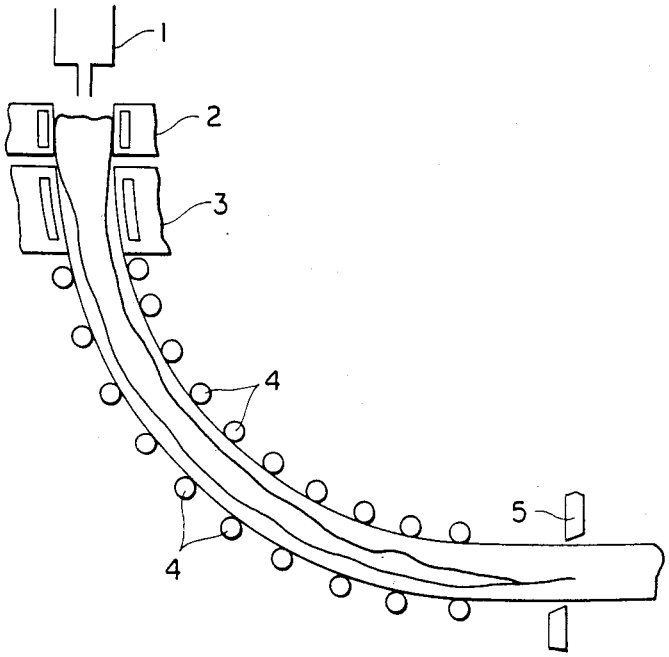
FIG. 1 is a schematic sectional view of a typical continuous casting operation to which the guide roller of the present invention is applicable.

Referring now to the accompanying drawings and first to FIG. 1, there is schematically shown typical continuous casting equipment as an example to which the guide roll of the present invention can be suitably applied. As illustrated in that figure, molten steel from a tundish 1 is continuously poured into a water-cooled mould 2. Upon entering the mould 2, the molten steel undergoes primary cooling and begins to form a solidified shell around the surface thereof. In the succeeding solidifying stage, the cast strand is withdrawn by a walking bar 3 and passed horizontally between the rows of guide rolls 4, undergoing secondary cooling by direct cooling using water spray or air mist before reaching a cutter 5 which severs the cast strand into a suitable length prior to transfer to a succeeding working stage. For economical use of the heat of the cast strand in the subsequent hot rolling stage, it is preferred to control the secondary direct cooling so that the cast strand to be served by the cutter retains a temperature of 1000° C.–1200° C., reducing dissipation of the heat of the cast strand through the guide rolls 4 as mentioned hereinbefore.

Figure 2:
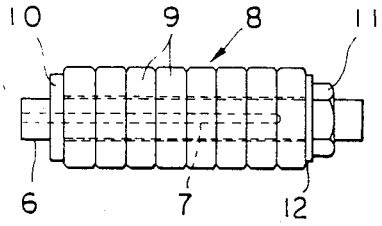
FIG. 2 is a side view of a guide roller according to the present invention.

FIG. 2 illustrates a guide roll according to the present invention, which is particularly suitable for use in the continuous casting operation as shown in FIG. 1. The guide roll has a core shaft 6 of common steel, a low alloy steel or the like which has a suitable strength. Mounted on and along the length of the core shaft 6 is a ceramic sleeve 8 consisting of a number of separate annular ceramic segments 9 which are loosely fitted on the circumference of the core shaft 6 and respectively held in intimate contact with the adjacent segments by axial restricting means, for example, by an end plate 10 fixed to one end of the core shaft 6 and a nut 11 tightly threaded on the other end of the core shaft 6 through a washer 12.

The above-described fundamental guide roll construction according to the present invention has various advantages as follows.

(I) The ceramic material has a relatively high strength against compressive forces but not against tensile forces. In this connection, it is to be noted that, although the bending moment which is caused by the reaction force of the cast strand as a result of its guidance is imposed on the roll, this bending moment is supported by the core shaft and will not act as tensile stress on the annular ceramic segments. It follows that the strength of the annular segments is suitably retained. Further, it becomes possible to preclude imposition of the maximum stress at the center portion of the outer periphery of the roll, which takes place in the case of the conventional integral roll construction.

(II) The outer ceramic sleeve 8 blocks the transfer of heat from the hot workpiece to the core shaft 6 by the high heat insulating property inherent to the ceramic material. Consequently, the core shaft 6 is subjected to heat to a reduced degree and elevation of its temperature is lessened by the water cooling, securing its strength at normal temperatures to cope with the above-mentioned bending moment.

(III) The coefficient of thermal expansion of the ceramic material is about $\frac{1}{3}$ of that of steel, so that, if the steel core shaft should undergo thermal expansion to a greater degree than the ceramic material, a ceramic sleeve which is integrally fitted on the core shaft or ceramic rings which are mounted on the core shaft by contraction fitting would be ruptured by tensile stress in some cases. However, the guide roll according to the invention is completely free of this drawback since the thermal expansion of the core shaft is reduced by the heat insulation of the ceramic sleeve and the water cooling, and the ceramic segments are loosely fitted on the core shaft.

(IV) The guide roll according to the invention can be assembled and disassembled in an easy and prompt manner. Accordingly, a damaged ceramic segment or segments can be replaced in a short time period and the job of repairing a damaged roll can be facilitated to a considerable degree.

(V) The reduction of heat dissipation from the cast strand contributes to energy conservation and makes it possible to cut the cast strand advantageously at a high temperature.

(VI) The service life of the roll is prolonged with lessened possibilities of bulging and internal cracking, so that improvements in the efficiency and productivity of the machine can be expected.

(VII) The guide roll of the present invention can be effectively applied not only to the continuous casting operations but also to the ingot-making operations and the anterior stage of hot rolling for guidance of hot workpieces.

Figure 3:
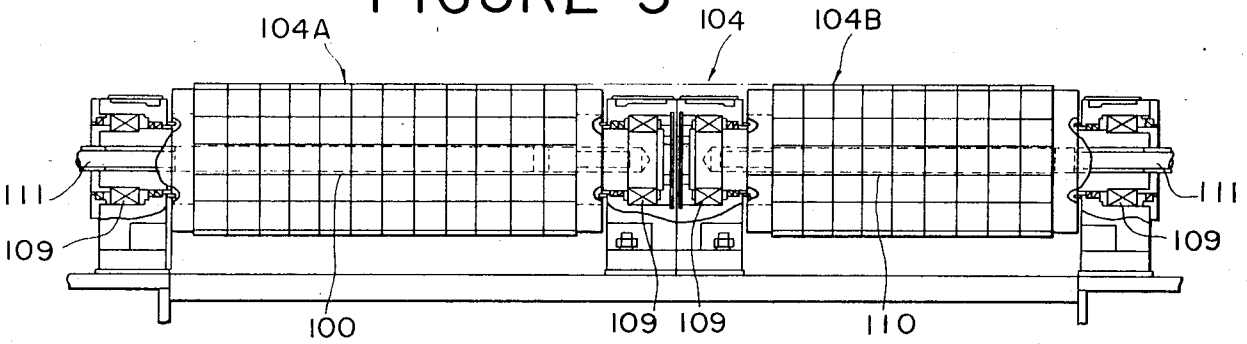
FIG. 3 is a schematic side view of a guide roll with an intermediate support construction according to the invention.

Referring to FIG. 3, there is shown another embodiment of the invention, wherein a guide roll 104 is constituted by a pair of partial rolls 104A and 104B which are disposed in series and coaxially with each other. Similarly to the foregoing embodiment, each one of the partial rolls 104A and 104B consists of a core shaft 106 of ordinary steel or low alloy steel serving as a support structure of a required strength, and an outer ceramic sleeve 108 formed by a multitude of cylindrically assembled ceramic segments 107. The partial rolls 104A and 104B are journalled in bearings 109 at the opposite ends of the respective core shafts 106, and provided with a water feed tube 111 at the outer ends in communication with axial cooling water passages 110 for cooling the core shafts 106. With this assembly type roll construction, a single guide roll unit 104 can be constituted by a pair of partial rolls for the purpose of avoiding the maximum stress which would otherwise act at the center of the guide roll.

Figure 4:
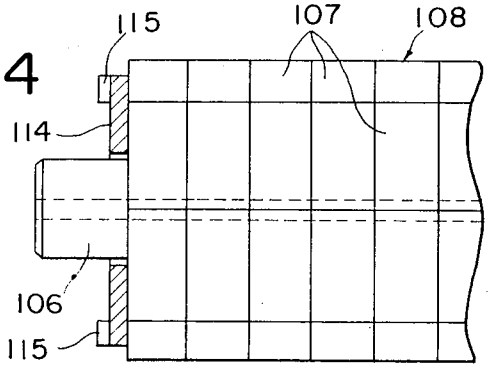
FIG. 4 is a partly cutaway end view of another embodiment.
Figure 5:
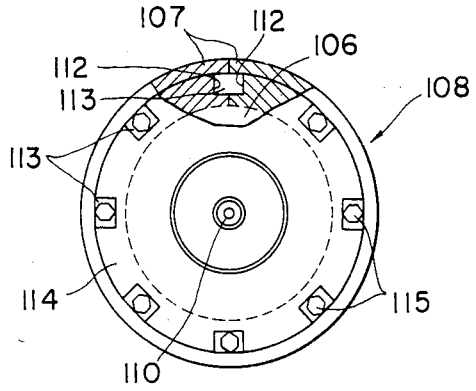
FIG. 5 is a fragmentary side view of a guide roll of the embodiment of FIG. 4.

In the embodiment shown in FIGS. 4 and 5, the ceramic sleeve 108 which covers the outer periphery of the roll core shaft 106 is constituted by a multitude of discrete ceramic segments 107 which are separable from adjacent segments in the axial and circumferential directions. Each ceramic segment 107 is formed in an arcuate shape in cross section and provided with key ways 112 on opposite lateral sides thereof, with no restrictive part existing relative to the core shaft 106. The ceramic segments 107 which form a ring around the circumference of the core shaft 106 are connected to the adjacent segments by keys 113 which are inserted in the opposing key ways 112 on the abutted lateral sides of the respective segments 107. These keys 113 are extended axially through the key ways 112 of the segments of the respective rings which are provided side by side along the length of the core shaft 106, and fixed to the end plates 114 at the opposite ends of the core shaft 106 by bolts 115, assembling the ceramic segments 107 in the form of a cylindrical sleeve 108.

Although the segments 107 are assembled without exposing the keys 113 on the outer side of the roll in this embodiment, the keys 113 which are embedded in the ceramic segments 107 are heated to a certain degree. In order to cope with the problem of thermal expansion of the keys 113, it is advisable to provide a clearance between the keys 113 and the key ways 112 of the ceramic segments 107, or a clearance which is broad enough for precluding contraction fitting between the keys 113 and the ceramic segments 107 in order to prevent imposition of excessively large stress on the latter. The keys 113 serve as means for restricting the respective segments 107 to the core shaft 106 at opposite ends thereof in cooperation with the end plates 114 and bolts 115, so that they serve to restrict movement of the individual segments in the axial and circumferential directions. Thermal expansion of the keys 113 in the axial direction can occur by sliding motion relative to the ceramic segments 107.

In the same manner as in the foregoing embodiment, the roll with a sleeve of axially and circumferentially discrete ceramic segments can prevent roll bending stress, resulting the static pressure of the roll bending stress imposed by the static pressure of the cast strand, from acting as tensile stress on the ceramic segments. Consequently, the roll construction advantageously utilizes the strength characteristics of the ceramic material which is relatively strong against compressive force. The strength under normal temperatures of the core shaft 106 which supports the bending force is maintained by the heat insulation of the ceramic sleeve 108 and internal water cooling. The ceramic segments 107 are very simple in shape and are easy to manufacture in conformity with a required accuracy.

Figure 6:
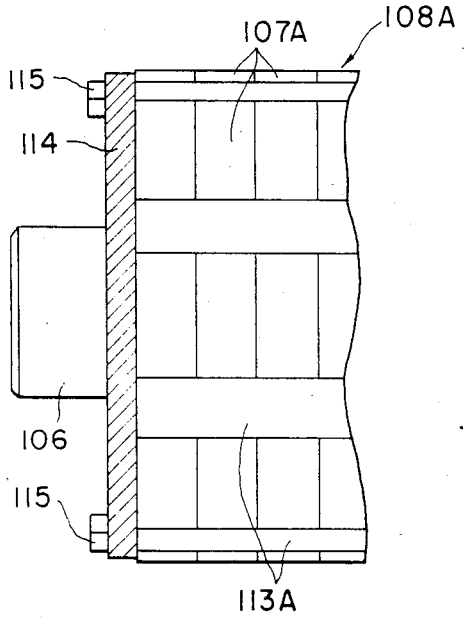
FIG. 6 is a view similar to FIG. 4 but showing another embodiment of the invention.
Figure 7:
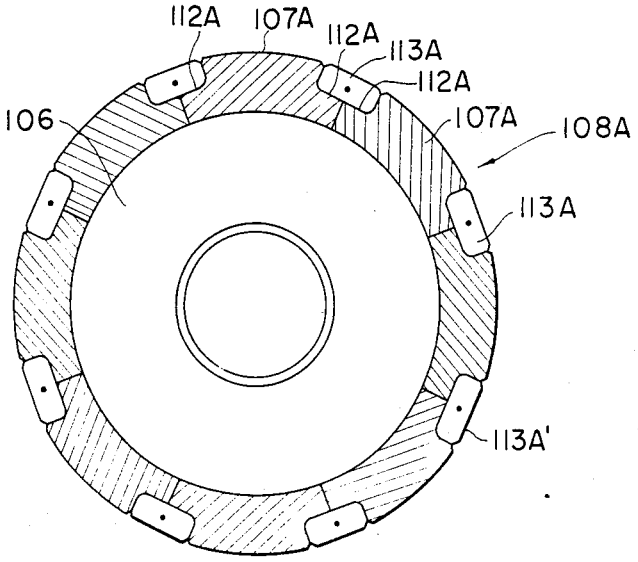
FIG. 7 is a view similar to FIG. 5 but showing the embodiment of FIG. 4.

Referring to FIGS. 6 and 7, there is shown a further embodiment of the invention, which is same as the embodiment of FIGS. 4 and 5 in construction and operation unless otherwise described below. In the embodiment of FIGS. 6 and 7, the ceramic segments 107A which are divided in the axial and circumferential directions of the roll are likewise formed in an arcuate shape in cross section with no restrictive part relative to the core shaft 106. However, in this case, axial key ways 112A are formed on the outer side at the abutting ends of the respective ceramic segments 107A, and keys 113A are each passed through the key ways 112A of two adjacent ceramic segments of each ring. The keys 113*a* are thus exposed on the outer side of the assembled caramic sleeve 108A, providing a segment assembly of open key construction.

The outer sides of the keys 113A are indented from the outer periphery of the assembled ceramic sleeve 108A to prevent direct contact with the hot cast strand Therfore, there occurs no direct heat transfer to the keys 113A except the radiation heat transfer which takes place to a much smaller degree, preventing heat dissipation from the cast strand. The ceramic segments in this embodiment have substantially the same functions as in the foregoing embodiments, contributing to heat insulation and resistance to abrasive wear while the core shaft contributes to the strength.

Figure 8:
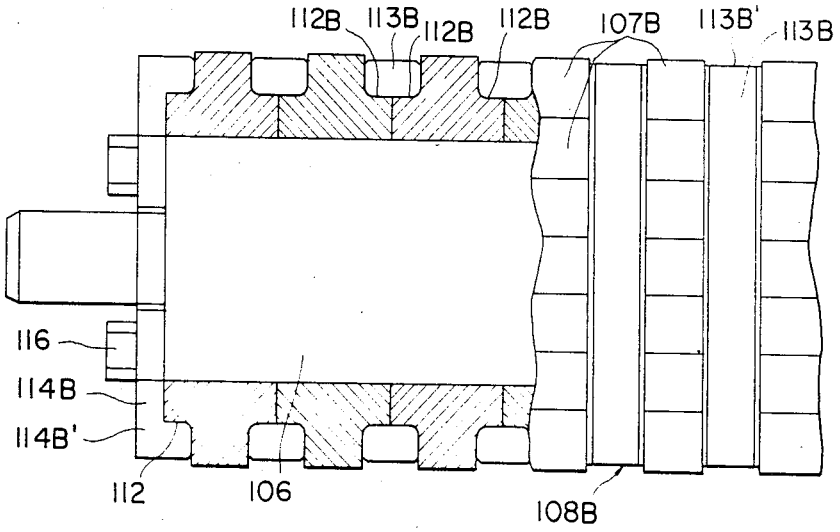
FIG. 8 is a partly cutaway side view of a guide roll of a modified construction employing steel rings for connecting ceramic segments.

FIG. 8 illustrates a modification with a ceramic sleeve 108B constituted by a multitude of ceramic segments which are similarly separated from each other in the axial and circumferential directions and formed in an arcuate shape in cross section with no restrictive part relative to the core shaft 106. In this case, the respective segments 107B are each provided with grooves 112B on the outer side along the opposite axial ends, and a number of steel rings 113B are employed as connecting means in place of the keys 113 (113A) of the foregoing embodiment. The ceramic segments 107B are arranged circularly to form rings around the core shaft 106 in intimate contact with the adjacent segments, and are respectively connected by the steel rings 113B which are fitted in the circumferential grooves 112B at the abutted axial ends of the adjacent segments. At the opposite ends of the roll, an annular flange 114B' which is formed on the inner side of the end plate 114B is fitted in the circumferential grooves 112B of the outermost ceramic ring of the ceramic segments 107B, and the end plate 114B is securely fixed to the core shaft 106 by mounting bolts 116, thereby restricting the sleeve 108B of the discrete segments 107B on the core shaft 106.

In this modification, the connecting rings are exposed on the circumference of the ceramic sleeve 108B, and the outer periphery of each steel ring 113B is also inwardly positioned from the circumferential surface of the assembled ceramic sleeve 108B to prevent its direct contact with the hot cast strand. The functions and the resulting effects of this guide roll are the same as in the foregoing embodiments.

Figure 9:
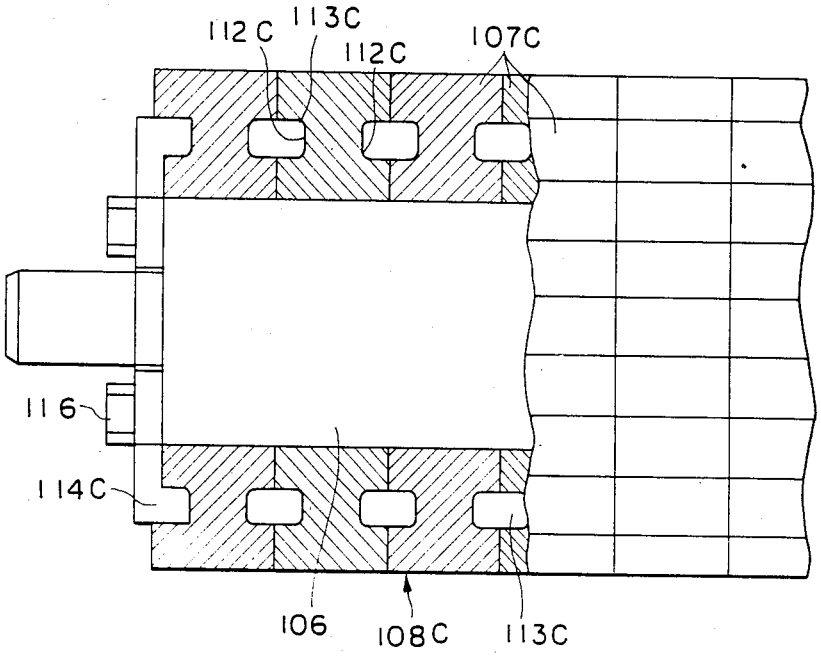
FIG. 9 is a view similar to FIG. 8 but showing another modification of the guide roll according to the present invention.

Referring to FIG. 9, there is shown another modification, wherein the respective ceramic segments 107C are connected and assembled into a cylindrical ceramic sleeve 108C by steel rings 113C which are anchored in annular grooves 112C formed centrally across the abutting axial end faces of the respective ceramic segment rings. This closed ring construction has the effects and functions similar to the embodiment shown in FIGS. 4 and 5.

Obviously, numerous modifications and variations of the present invention are possible in light of the above teachings. It is therefore to be understood that within the scope of the appended claims, the invention may be practiced otherwise than as specifically described herein.

What is claimed is:

1. A guide roll, comprising:

a steel core shaft internally provided with a cooling water passage along an axis thereof;

a ceramic sleeve covering a circumferential portion of said core shaft wherein said ceramic sleeve further comprises a plurality of separable annular ceramic segments loosely fitted on and along a length of said core shaft; and fixing means for holding said annular ceramic segments in an axially abutted state on said core shaft wherein said fixing means further comprises an end plate fixed to a first end of said core shaft and a nut tightly threaded on a second end of said core shaft opposite said first end.

2. A guide roll as set forth in claim 1, wherein said guide roll further comprises a pair of coaxially juxtaposed rolls and means for rotatably supporting each of said rolls at opposite ends thereof.

3. A guide roll as set forth in claim 1, wherein each of said annular ceramic segments further comprise a plurality of subsegments of an arcuate shape in cross section, said segments of said ceramic sleeve being arranged circularly around the circumference of said core shaft in abutting engagement with adjacent subsegments at the opposite lateral sides and further comprising a plurality of key members extending in an axial direction of said core shaft for restricting said subsegments.

4. A guide roll as set forth in claim 3, wherein said subsegments include a plurality of axial grooves formed centrally across abutted lateral sides therein and within which said key members are fitted.

5. A guide roll as set forth in claim 3, wherein said segments include a plurality of axial grooves formed at the upper outer corners of abutted lateral sides thereof and within which said key members are fitted.

6. A guide roll as set forth in claims 3, 4 or 5, further comprising a pair of end plates securely fixed to the opposite ends of said core shaft for restricting said ceramic sleeve in position on said core shaft.

7. A guide roll as set forth in claim 1, wherein each of said annular ceramic segments further comprise a plurality of subsegments of an arcuate shape in cross section, said subsegments of said ceramic sleeve being arranged circularly around the circumfernce of said core shaft in abutting engagement with adjacent subsegements at opposite lateral sides and further comprising a plurality of steel rings fitted in annular grooves formed in axial abutted ends of said annular ceramic segments and interconnecting said subsegments.

8. A guide roll, comprising:

a steel core shaft internally provided with a cooling water passage along an axis thereof;

a ceramic sleeve covering a circumferential portion of said core shaft wherein said ceramic sleeve further comprises a plurality of separable annular ceramic segments loosely fitted on and along a length of said core shaft; and fixing means for holding said annular ceramic segments in an axially abutted state on said core shaft wherein each of said annular ceramic segments further comprise a plurality of subsegments of an arcuate shape in cross section, said subsegments of said ceramic sleeve being arranged circularly around the circumference of said core shaft in abutting engagement with adjacent subsegments at opposite lateral sides and further comprising a plurality of steel rings fitted in annular grooves formed in axial abutted ends of said annular ceramic segments and interconnecting said subsegments wherein said annular grooves are formed centrally across axial abutted end faces of said subsegments of said adjacent ceramic segments.

9. A guide roll, comprising:

a steel core shaft internally provided with a cooling water passage along an axis thereof;

a ceramic sleeve covering a circumferential portion of said core shaft wherein said ceramic sleeve further comprises a plurality of separable annular ceramic segments loosely fitted on and along a length of said core shaft; and fixing means for holding said annular ceramic segments in an axially abutted state on said core shaft wherein each of said annular ceramic segments further comprise a plurality of subsegments of an arcuate shape in cross section, said subsegments of said ceramic sleeve being arranged circularly around the circumference of said core shaft in abutting engagement with adjacent subsegments at opposite lateral sides and further comprising a plurality of steel rings fitted in annular grooves formed in axial abutted ends of said annular ceramic segments and interconnecting said subsegments wherein said annular grooves are formed on an outer side of respective subsegments at and along abutted axial ends thereof.

10. A guide roll, comprising:

a steel core shaft internally provided with a cooling water passage along an axis thereof;

a ceramic sleeve covering a circumferential portion of said core shaft wherein said ceramic sleeve further comprises a plurality of separable annular ceramic segments loosely fitted on and along a length of said core shaft; and fixing means for holding said annular ceramic segments in an axially abutted state on said core shaft wherein each of said annular ceramic segments further comprise a plurality of subsegments of an arcuate shape in cross section, said subsegments of said ceramic sleeve being arranged circularly around the circumference of said core shaft in abutting engagement with adjacent subsegments at opposite lateral sides and further comprising a plurality of steel rings fitted in annular grooves formed in axial abutted ends of said annular ceramic segments and interconnecting said subsegments; and a pair of end plates securely fixed to opposite ends of said core shaft for restricting said ceramic sleeve in position on said core shaft.

* * * * *